US007836796B2

(12) United States Patent
Chang

(10) Patent No.: US 7,836,796 B2
(45) Date of Patent: Nov. 23, 2010

(54) SCREWING DEVICE

(75) Inventor: Hu-Sung Chang, Taipei (TW)

(73) Assignee: Pegatron Corporation, Taipei (TW)

( * ) Notice: Subject to any disclaimer, the term of this patent is extended or adjusted under 35 U.S.C. 154(b) by 9 days.

(21) Appl. No.: 12/186,964

(22) Filed: Aug. 6, 2008

(65) Prior Publication Data

US 2009/0038448 A1 Feb. 12, 2009

(30) Foreign Application Priority Data

Aug. 9, 2007 (TW) ..... 96129459 A

(51) Int. Cl.
*B25B 23/00* (2006.01)

(52) U.S. Cl. ..... 81/57.22

(58) Field of Classification Search ..... 81/57.22, 81/57.32, 57.36
See application file for complete search history.

(56) References Cited

U.S. PATENT DOCUMENTS 2,444,602 A * 7/1948 Hardie ..... 408/124
6,058,810 A * 5/2000 Junkers ..... 81/56
6,134,989 A * 10/2000 Stevens ..... 81/57.22
6,668,685 B2 * 12/2003 Boston ..... 81/57.22
2004/0001316 A1 1/2004 Kamikawa
2004/0250639 A1 12/2004 Winkler
2005/0188795 A1 * 9/2005 Woltz ..... 81/57.36
2006/0236817 A1 * 10/2006 Junkers ..... 81/57.22

FOREIGN PATENT DOCUMENTS

CN 1803406 A 7/2006
CN 2867805 2/2007

* cited by examiner

*Primary Examiner*—David B Thomas
(74) *Attorney, Agent, or Firm*—Muncy, Geissler, Olds & Lowe, PLLC

(57) ABSTRACT

A screwing device includes a holder, an interaction unit and a screwing unit. The holder has a rotation axle. The interaction unit is connected to the rotation axle and has an interaction ring. The screwing unit has a plurality of screwing elements and interacts with the inner peripheral surface of the interaction ring. When the holder rotates along a screwing direction, the interaction ring also rotates along the same screwing direction and drives the screwing unit to rotate along the same screwing direction.

9 Claims, 6 Drawing Sheets

SCREWING DEVICE

CROSS REFERENCE TO RELATED APPLICATIONS

This Non-provisional application claims priority under 35 U.S.C. §119(a) on Patent Application No(s). 096129459 filed in Taiwan, Republic of China on Aug. 9, 2007, the entire contents of which are hereby incorporated by reference.

BACKGROUND OF THE INVENTION

1. Field of Invention

The invention relates to a screwing device and, more particularly, to a screwing device which can screw a plurality of screwing elements simultaneously.

2. Related Art

With the gradual increase of the operating speed of the central processing unit (CPU), the heat generated by the CPU in the operation is also increased gradually. Therefore, the heat dissipation technology becomes one of focal points in the development of the computer technology.

Please refer to FIG. 1. A heat dissipation module 2 of a CPU chip 1 includes a copper sheet 21, a heat pipe 22 and an elastic piece 23. The copper sheet 21 is used to transfer the heat generated by the CPU chip 1 to the heat pipe 22, and then the heat is transferred to a fan (not shown) via the heat pipe 22 to be exhausted. The elastic piece 23 is used to make the heat dissipation module 2 fixed with the CPU chip 1. In addition, heat dissipation cream can be further provided at the connecting part between the heat dissipation module 2 and the CPU chip 1 to increase the heat dissipation efficiency and make the CPU chip 1 connected with the copper sheet 21.

To make the elastic piece 23 apply an even force on the CPU chip 1, so that the copper sheet 21 can transfer the temperature from the CPU chip 1 to the heat pipe 22 evenly. The pins of the chip will not be destroyed because of the uneven pressure, the force applied on the elastic piece 23 should be even when a plurality of screws 231 passes through the screw holes of the elastic piece 23 and fixes the elastic piece 23 on a circuit base 5.

However, in the conventional technology for fixing the elastic piece 23, each screw 231 is screwed by a screwdriver 3, respectively. In this way, the forces applied on the screw holes of the elastic piece 23 are easily to be different, so that the contact area between the heat dissipation module 2 and the top surface of the CPU chip 1 is not uniform, and the heat dissipation module 2 can not work effectively to take away the heat of the CPU chip 1 evenly. Furthermore, the pins of the CPU chip 1 will be destroyed, which will affect the efficiency of the CPU chip 1. In addition, the time for screwing each screw 231, respectively, is also longer. If the screwing force is much uneven, the caused stress even can make the circuit base 5 bent.

SUMMARY OF THE INVENTION

A screwing device which can screw a plurality of screws simultaneously is provided in a preferred embodiment of the invention.

According to an embodiment, a screwing device of the invention includes a holder, an interaction unit and a screwing unit. The holder has a rotation axle. The interaction unit is connected with the rotation axle and has an interaction ring. The screwing unit has a plurality of screwing elements which interact with the inner peripheral surface of the interaction ring, wherein when the holder rotates along a screwing direction, the interaction ring also rotates along the screwing direction and drives the screwing unit to rotate along the screwing direction.

From the above, the screwing device of a preferred embodiment of the invention utilizes an interaction unit to drive a plurality of screwing elements simultaneously and make the screwing elements rotate along the same screwing direction with the holder. Therefore, when a user rotates the holder along a screwing direction, the interaction unit also drives the plurality of screwing elements to rotate along the screwing direction. Therefore, a user can apply an even force and screw a plurality of screws simultaneously to avoid various problems caused by the uneven force applied on each screw.

These and other features, aspects, and advantages of the present invention will become better understood with regard to the following description, appended claims, and accompanying drawings.

DETAILED DESCRIPTION OF THE INVENTION

A screwing device according to a preferred embodiment of the invention is described with related drawings hereinbelow. The same elements thereof are denoted by the same reference numbers.

Figure 1:
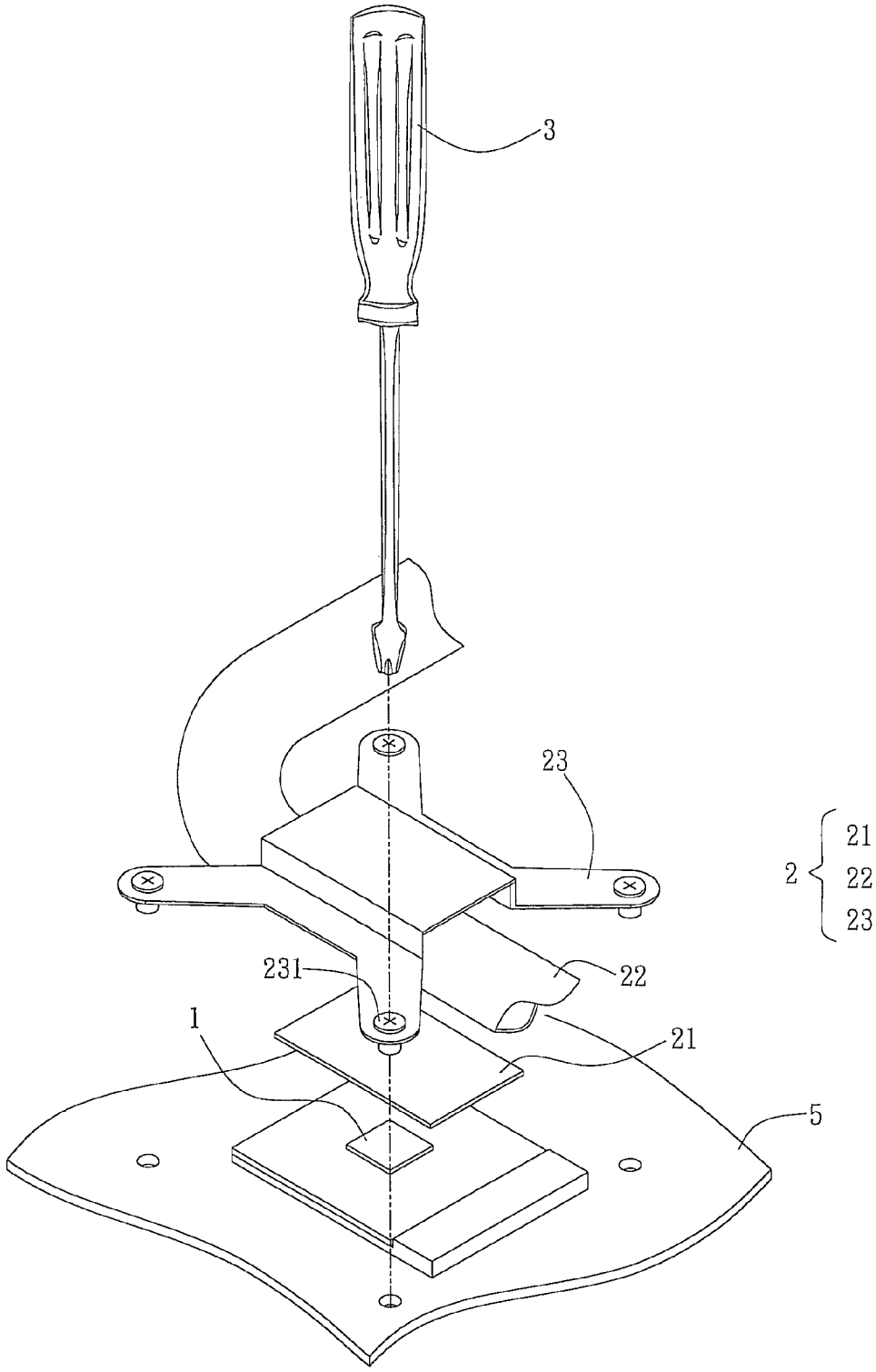
FIG. 1(Prior Art)
FIG. 1 is a schematic diagram showing a conventional method for fixing a heat dissipation module by a screwdriver.
Figure 2:
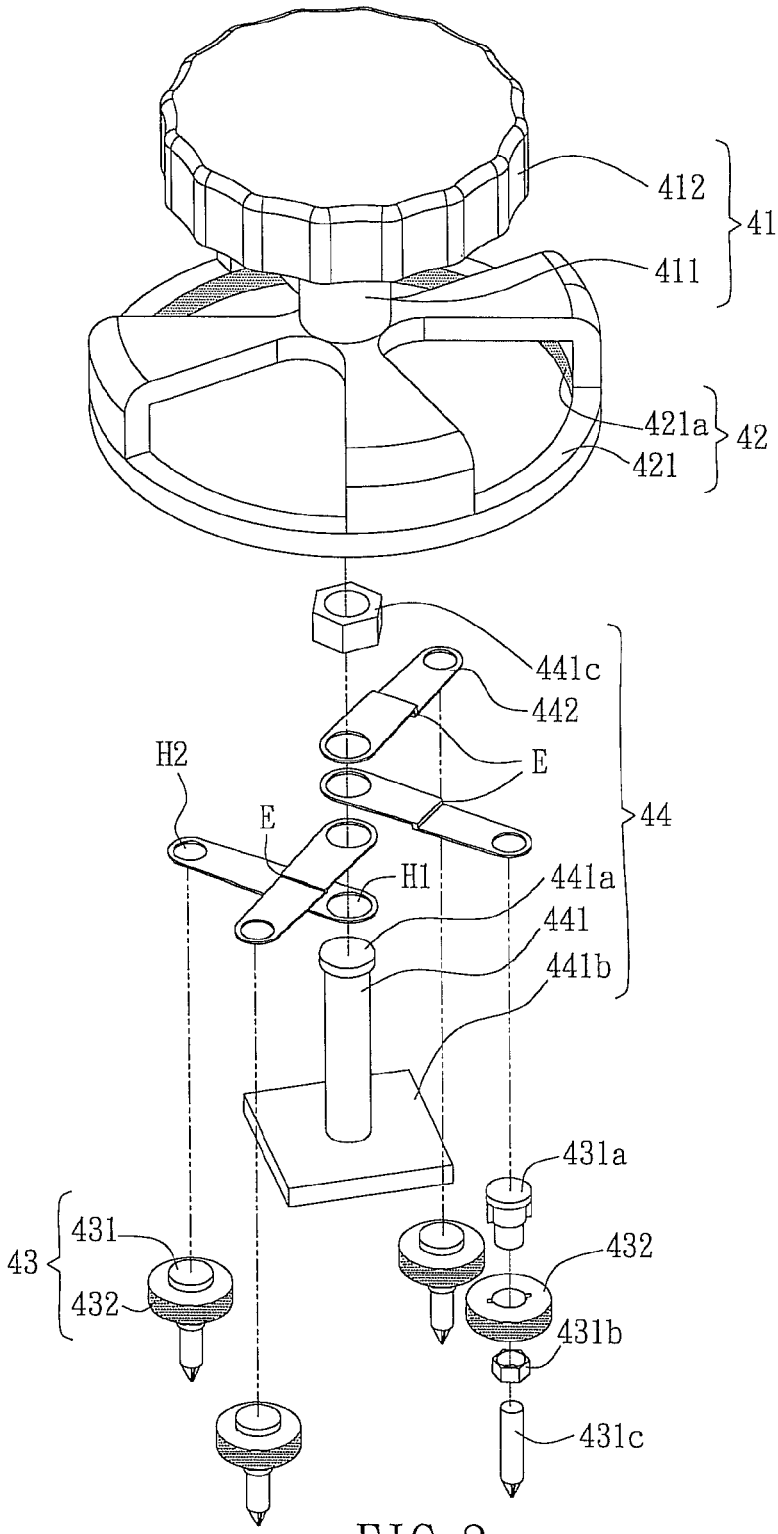
FIG. 2 is an exploded diagram showing a screwing device of a preferred embodiment of the invention.

Please refer to FIG. 2. The screwing device 4 according to a preferred embodiment of the invention includes a holder 41, an interaction unit 42 and a screwing unit 43.

The holder 41 has a rotation axle 411. In addition, in the embodiment, the holder 41 further has a hold portion or handle 412 which is fixedly connected with the rotation axle 411 to make the hold convenient. The rotation axle 411 and the hold portion 412 also can be integrally formed.

The interaction unit 42 is connected with the rotation axle 411 and has an interaction ring 421. In addition, the interaction unit 42 and the holder 41 also can be integrally informed.

The screwing unit 43 has a plurality of screwing elements 431 which interact with the inner peripheral surface 421*a* of the interaction ring 421, respectively. In the embodiment, four screwing elements 431 are taken as an example. In addition, the screwing unit 43 of the embodiment further has a plurality of braking or engaging elements 432 which contact with the inner peripheral surface 421*a* of the interaction ring. Each of the screwing elements 431 is provided through and fixed at each of the braking elements 432 correspondingly. Four braking elements 432 are taken as an example in the embodiment herein.

The screwing element 431 further can has a key pin 431*a*, a nut 431*b* and a screwdriver 431*c* which is provided through the key pin 431*a* and fixed by the nut 431*b*. The screwing element 431 is fixed with the inner portion of the braking element 432 by the protrudent portions on the two sides of the key pin 431*a*. Therefore, different screwdrivers 431*c* can be replaced by disassembling the nut 431*b* in use. The structure and the combination of the screwing element 431 are not limited by the embodiment. The key pin 431*a* and the screwdriver 431*c* also can be directly integrally formed. Other manner also can be used, but it is preferred to make them fixed with the braking element 432 and enable the screwdriver 431*c* to be replaced.

The inner peripheral surface 421*a* of the interaction ring 421 can be a rough or frictional surface, while the braking element 432 also has a rough or frictional surface corresponding to the inner peripheral surface 421*a*. Thus, the screwing unit 43 can interact with the interaction ring 421 to rotate via the surface friction.

Figure 3:
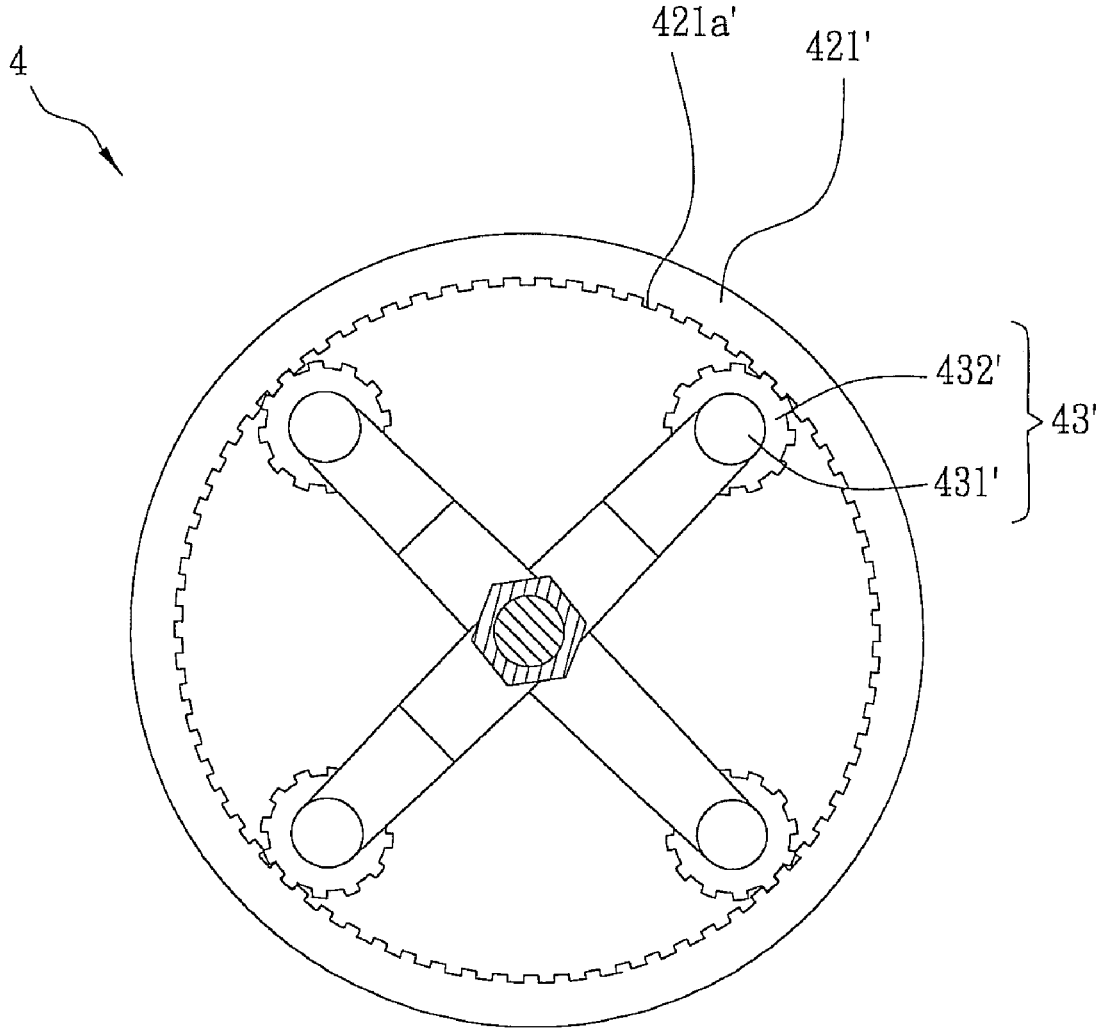
FIG. 3 is a top view showing an interaction ring and a screwing unit of a preferred embodiment of the invention in another status.

Please refer to FIG. 3, which is a top view of the interaction ring 421' and the screwing unit 43' in another status. To make the drawing clear, the holder 41 is omitted. Besides the rough surface can be used to cause the effect of interaction, the gear also can be used by the interaction ring 421' and the screwing unit 43' to obtain the effect of interaction. The inner peripheral surface 421*a*' of the interaction ring 421' is gear-toothed, and the braking element 432' is a correspondingly gear. The tooth pitch of the braking element 432' corresponds to the tooth pitch of the inner peripheral surface 421*a*'. When the interaction ring 421' rotates, the braking element 432' of the screwing unit 43' also rotates to drive the screwing element 431' to rotate.

Please refer to FIG. 2 again. The screwing device 4 of the embodiment further has a fixing or driver holding unit 44 including an axle 441 and a plurality of connecting arms 442. Wherein, four connecting arms 442 corresponding to the four screwing elements 431 are taken as an example in the embodiment.

The axle 441 can utilize a cylinder which one end thereof 441*a* is connected with the rotation axle 411, and the other end has a bottom plate 441*b*.

Each connecting arm 442 has a first opening H1 and a second opening H2, respectively. Each connecting arm 442 can be fixed on the bottom plate 441*b* by making each first opening H1 telescopically received with the axis 441. Meanwhile, the axis 441 is provided through a nut 441*c*, and a screw thread (not shown) corresponding to the axis 441 is provided. Thus, each connecting arm 442 can abut against with each other and be fixed between the bottom plate 441*b* and the nut 441*c*. In addition, the positions of the screwing elements 431 can be fixed by making the screwing elements 431 telescopically received with the second openings H2 of the connecting arms 442.

The position of each connecting arm 442 can be adjusted via the first opening H1 and the axle 441 as the center of a circle, so that the position of each screwing element 431 can also be adjusted. In addition, to make the screwing force even, each screwing element 431 and each second opening H2 should be at the same plane. Therefore, at least one connecting arm 442 has a sectional difference E between two ends. In the embodiment, except for the connecting arm 442 which is closest to the bottom plate 441*b* of the axle 441, each of the other three connecting arms 442 all has a sectional difference E with different size between two ends thereof. Of course, besides the sectional difference E on the connecting arm can make the screwing element 431 and the second opening H2 provided at the same plane. The connecting arm 442 also can be designed to be radial and integrally formed. In this way, the sectional difference is not needed.

Figure 4:
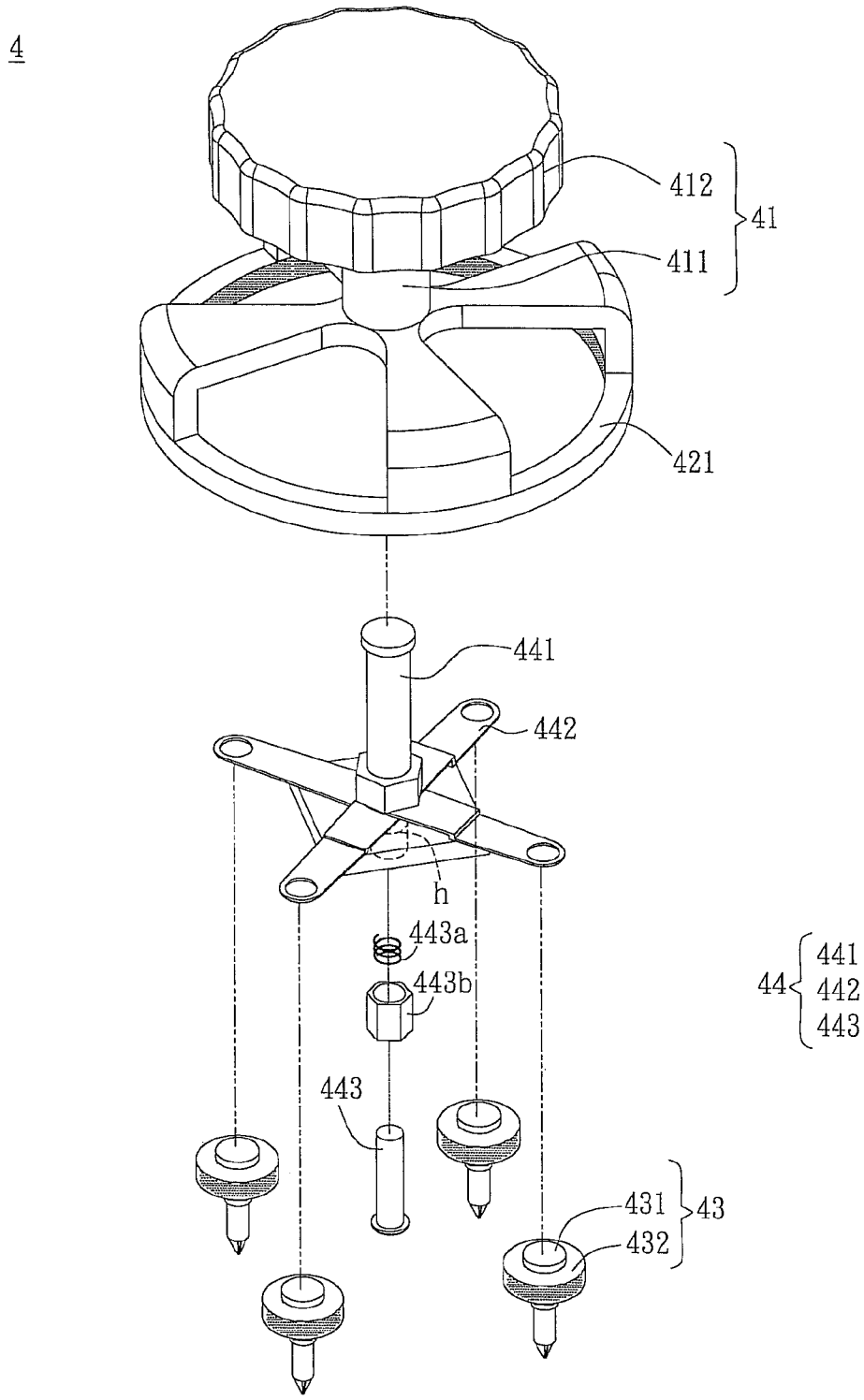
FIG. 4 is an exploded diagram showing a screwing device of a preferred embodiment of the invention in another status.

Please refer to FIG. 4. The fixing unit 44 further includes an elastic thimble or spring loaded rod 443 which passes through an opening h of the bottom plate 441*b* at the other end of the axle 441 and is telescopically assembled with the axle 441. A spring 443*a* provided at one end where the elastic thimble 443 is connected with the axle 441 can generate a buffering power. The elastic thimble 443 can be against the screwed element to avoid too large force in screwing. In addition, the elastic thimble 443*a* can further be provided through a nut 443*b* to adjust the vertical distance between the screwing device 4 and the element in screwing.

Figure 5A:
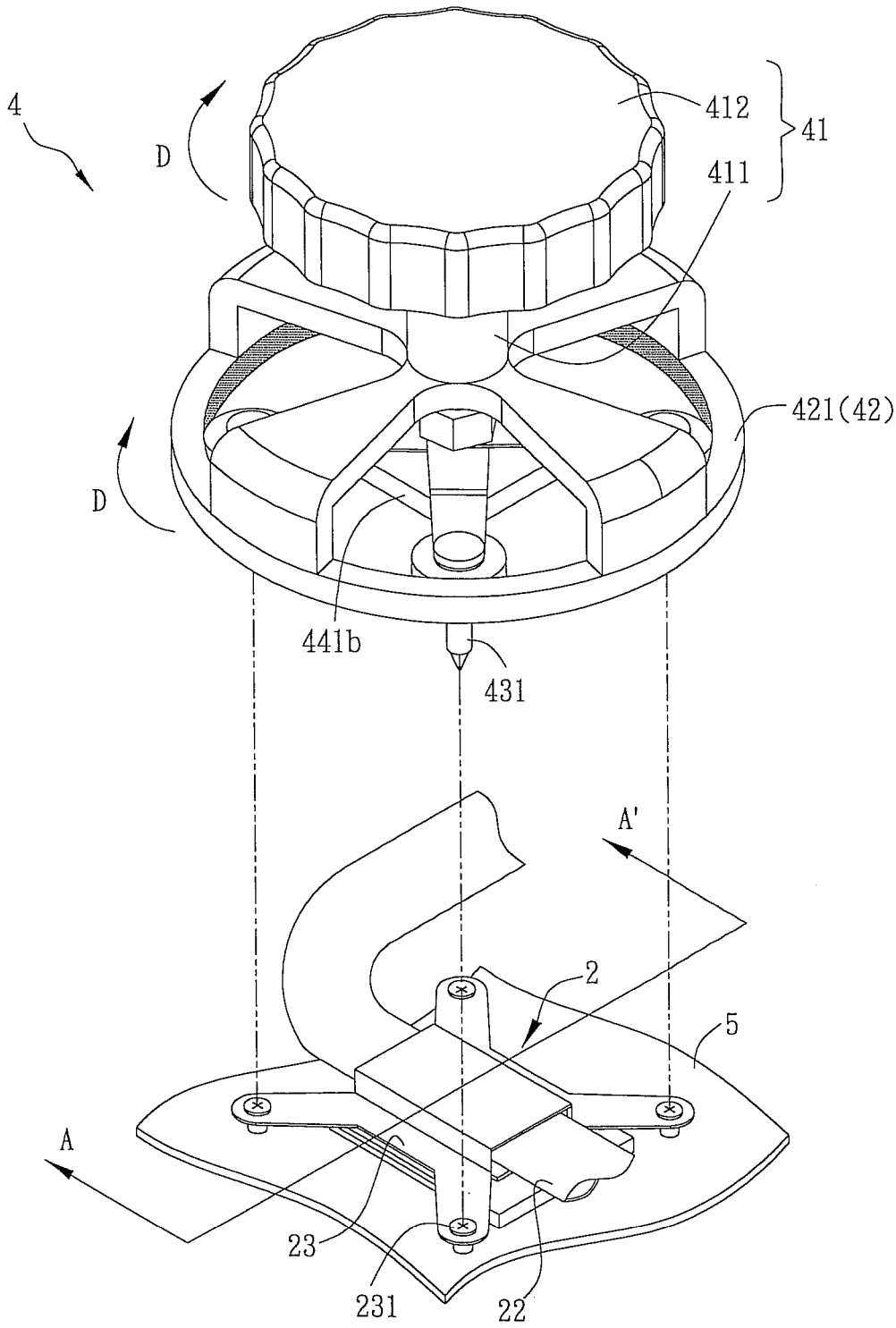
FIG. 5A is a schematic diagram showing that a screwing device of a preferred embodiment of the invention is used to screw a heat dissipation module.
Figure 5B:
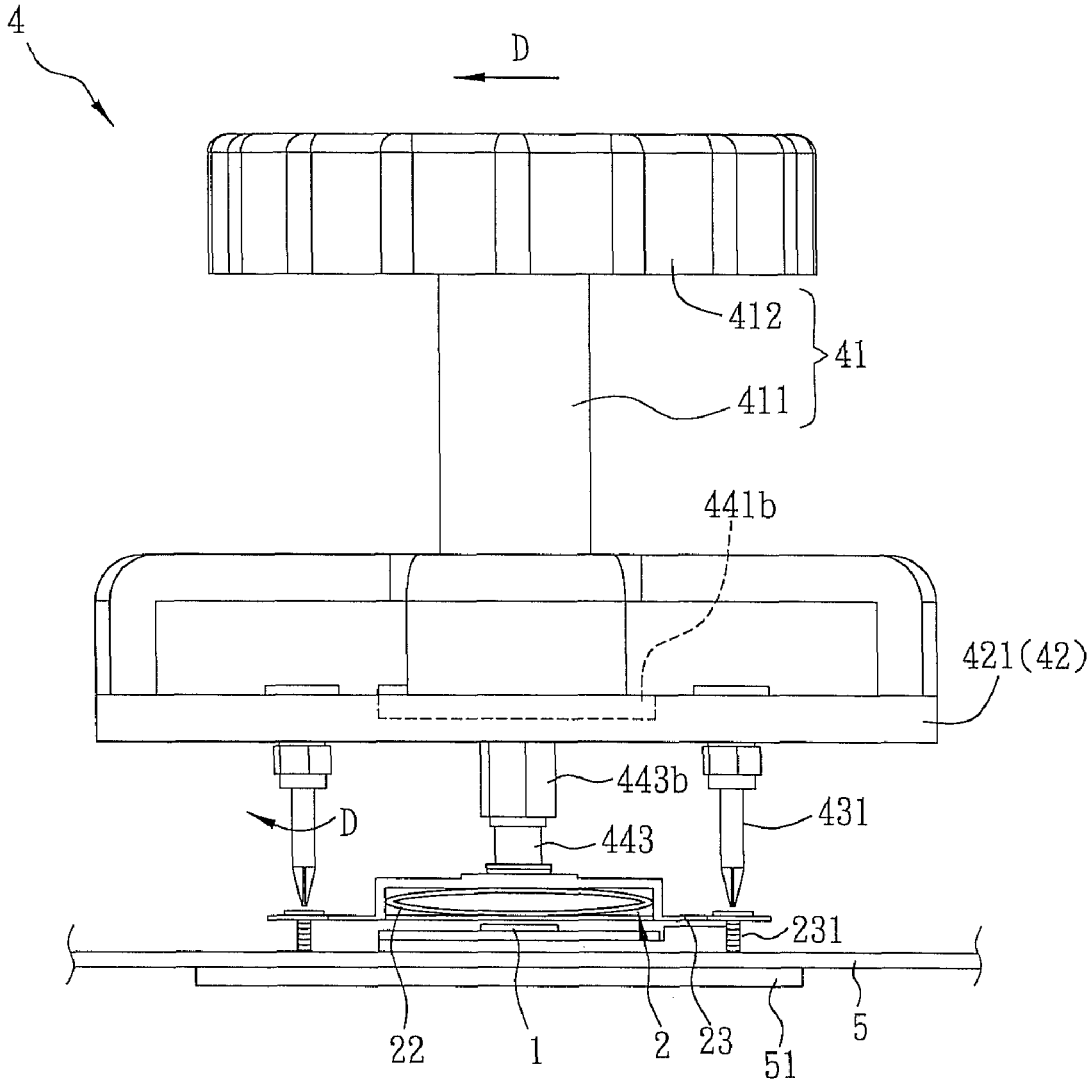
FIG. 5B is a section side view along A-A' line showing that the screwing device is used to screw the heat dissipation module shown in FIG. 5A.

Please refer to FIG. 4, FIG. 5A and FIG. 5B simultaneously. When the screwing device 4 in the embodiment is used to screw the four screws 231 of the heat dissipation module 2, a user can make each screwing element 431 of the screwing unit 43 aim at each screw 231 at the connecting foot of the elastic piece 23 of the heat dissipation module 2 first. At that moment, the elastic thimble of the fixing unit 44 also is against the elastic piece 23. Then, the user can rotate the hold portion 412 of the holder 41 along a screwing direction D (taking the clockwise as example), and the rotation axle 411 drives the interaction ring 421 to rotate along the screwing direction D. At the same time, each screwing element 431 of the screwing unit 43 also rotates along the screwing direction, thereby an even force can be used to screw the four screws 231 simultaneously.

As the screwing elements 431 screw the screws 231 into the screwing seat 51 of the circuit base 5, the screwing device gradually moves downwards, and the elastic thimble 443 gradually moves upwards and into the axle 441. When the nut 443*b* at the elastic thimble 443 is against the bottom plate 441*b* of the axle 441, the screwing device 4 can not continue screwing the screws 231 into the screwing seat 51 of the circuit base 5. In this way, the elastic piece 23 of the heat dissipation module 2 will not apply too large pressure on the CPU chip 1, and CPU chip 1 will not be destroyed.

On the contrary, if the screws 231 need to be loosed simultaneously, a user only needs to rotate the hold portion 412 of holder 41 along a direction (such as an anticlockwise direction) contrary to the screwing direction D, and then the screws 231 can be loosed simultaneously.

Therefore, utilizing the screwing device 4 of the embodiment to screw a plurality of screws 231 provided through the elastic piece 23 of the heat dissipation module 2 simultaneously can avoid the problem that when the screws are screwed, respectively, the uneven force makes the contact area between the heat dissipation module 2 and the top surface of the CPU 1 uneven. It also avoids the problem that the heat dissipation module 2 can not work effectively or the circuit base 5 is bent by the uneven force and other problems. In addition, it also can avoid the problem that the elastic piece 23 of the heat dissipation module 2 applies too large pressure on the CPU 1, which will destroy the CPU chip 1.

The screwing device 4 of an embodiment of the invention is not only used for fixing heat dissipation module 2, it can be used in any situation when a plurality of screws need be screwed simultaneously. For example, the screwing device 4 also can be used for screwing a plurality of screw holes on connecting ports of peripheral elements on a computer.

To sum up, a screwing device according to an embodiment of the invention utilizes an interaction unit to drive a plurality of screwing elements and make each screwing element and the holder rotate along the same direction. Therefore, when a user rotates the holder along a screwing direction, the interaction unit also drives a plurality of screwing elements to rotate along the screwing direction. Then, a user can apply an even force to screw a plurality of screws simultaneously to avoid various problems caused by uneven force on the screws.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A screwing device comprising:

a holder having a rotation axle and a handle fixedly connected to a bottom of the rotation axle;

a center of an interaction unit fixedly connected to a bottom of the rotation axle and having an interaction ring; and a screwing unit having a plurality of screwing elements, each of which is a screwdriver, which interacts with an inner peripheral surface of the interaction ring, respectively;

wherein when the holder rotates along a screwing direction, the interaction ring also rotates along the screwing direction and drives the screwing elements to rotate along the screwing direction.

2. The screwing device according to claim 1, wherein the screwing unit further comprises a plurality of engaging elements, and the outer peripheral surface of the engaging elements contact with the inner peripheral surface of the interaction ring, and the screwing elements are provided through the engaging elements, respectively.

3. The screwing device according to claim 2, wherein the inner peripheral surface of the interaction ring has a plurality of gear teeth, and each of the engaging elements is a gear corresponding to the gear teeth of the inner peripheral surface.

4. The screwing device according to claim 2, wherein the inner peripheral surface of the interaction ring is a frictional surface, and each of the engaging elements also has a corresponding frictional surface.

5. The screwing device according to claim 1 further comprising:

a driver holding unit having an axle and a plurality of connecting arms, wherein one end of the axle is connected to the rotation axle, and one end of each of the connecting arms is telescopically assembled with the axle, respectively, and each of the screwing elements is at the other end of each of the connecting arms, respectively.

6. The screwing device according to claim 5, wherein each of the connecting arms has a first opening and a second opening, and the first opening is telescopically assembled with the axle, and the second opening is connected to each of the screwing elements.

7. The screwing device according to claim 6, wherein the second openings are at the same plane.

8. The screwing device according to claim 5, wherein at least one of the connecting arms has a sectional difference between one end and the other end thereof.

9. The screwing device according to claim 5, wherein the driver holding unit further comprises a spring loaded rod which is telescopically within the axle.

* * * * *